US008016137B2

(12) United States Patent
Shaha

(10) Patent No.: US 8,016,137 B2
(45) Date of Patent: Sep. 13, 2011

(54) WALL-MOUNTABLE STORAGE SYSTEM

(75) Inventor: Kevin Bruce Shaha, Dover, ID (US)

(73) Assignee: Illinois Tool Works Inc., Glenview, IL (US)

( * ) Notice: Subject to any disclaimer, the term of this patent is extended or adjusted under 35 U.S.C. 154(b) by 117 days.

(21) Appl. No.: 12/391,659

(22) Filed: Feb. 24, 2009

(65) Prior Publication Data

US 2010/0213149 A1 Aug. 26, 2010

(51) Int. Cl.
*A47H 1/00* (2006.01)

(52) U.S. Cl. ..... 211/103; 211/193; 248/200

(58) Field of Classification Search ..... 211/90.01, 211/90.04, 103, 119.003, 134, 186, 70.4, 211/193, 87.01, 59.1, 105.1, 105.2, 189; 248/235, 250, 241, 243, 200
See application file for complete search history.

(56) References Cited

U.S. PATENT DOCUMENTS 648,454 A * 5/1900 Deland ..... 211/105.1
945,138 A * 1/1910 Peterson ..... 248/243
1,802,964 A * 4/1931 Brady ..... 248/73
2,827,254 A * 3/1958 Faber ..... 248/243
3,371,798 A 3/1968 D'Altrui
3,468,430 A * 9/1969 Lawman ..... 211/182
3,503,524 A 3/1970 Krummell et al.
3,525,442 A 8/1970 Novales
3,602,374 A * 8/1971 Alabaster ..... 211/193
3,787,016 A * 1/1974 Laval, Jr. ..... 248/49
3,923,277 A * 12/1975 Perrault et al. ..... 248/49
4,018,167 A * 4/1977 Spangler ..... 108/152
4,236,641 A * 12/1980 Marcenne ..... 211/87.01
4,396,125 A 8/1983 Rowader
4,444,323 A 4/1984 Travis
4,474,299 A * 10/1984 Andrews ..... 211/193
5,318,264 A * 6/1994 Meiste ..... 248/222.12
5,816,542 A * 10/1998 Rinderer ..... 248/58
6,019,331 A 2/2000 Hoogland et al.
6,082,690 A * 7/2000 Durin et al. ..... 248/241
6,129,224 A * 10/2000 Mingers ..... 211/193
6,196,141 B1 * 3/2001 Herron et al. ..... 108/108
6,402,108 B1 * 6/2002 Remmers ..... 248/243
2009/0050863 A1 * 2/2009 Conway et al. ..... 256/13.1

* cited by examiner

*Primary Examiner* — Darnell Jayne
*Assistant Examiner* — Stanton L Krycinski
(74) *Attorney, Agent, or Firm* — Mark W. Croll; Patricia M. Chidiac; Beem Patent Law Firm

(57) ABSTRACT

A wall-mountable storage system, comprising a plurality of uprights having a mounting flange, an extending surface and a bracket interfacing flange, each upright having a plurality of openings spaced each of the mounting flange, the bracket interfacing flange and the extending surface for mounting the system to a wall, accepting passage of the brackets through the uprights, and mounting the brackets to the uprights, respectively. The configuration and load application of the system may increase the sheer component of loading on the system and decrease the bending moment component, thereby increasing the maximum load capacity of the system.

13 Claims, 4 Drawing Sheets

WALL-MOUNTABLE STORAGE SYSTEM

BACKGROUND OF THE INVENTION

1. Field of the Invention

The present invention is directed to a cantilevered system for storing objects, particularly a wall-mountable system.

2. Description of the Related Art

There are many types of cantilever racks used for storing objects or for shelving. These racks typically include a support from which arms extend outward with loads applied to those arms. Oftentimes, these arms are easily dislodged, such as when an object supported by the arm is removed. In addition, cantilever racks, by their very nature, are susceptible to bending moments, which can decrease their holding capacities. Moreover, because of these bending moments, many of these racks are have substantial bases that rest on the floor to provide increased stability. As such, these racks may be cumbersome or of limited use because they require significant open floor spaces for their installation.

What is needed is a storage system that overcomes these aforementioned drawbacks.

BRIEF SUMMARY OF THE INVENTION

In one embodiment, a wall-mountable storage system, comprising a plurality of S-shaped uprights having a mounting flange, an extending surface and a bracket interfacing flange, each upright having a plurality of openings spaced along the mounting flange, a second plurality of openings spaced along the bracket interfacing flange and a third plurality of openings spaced along the extending surface; a plurality of brackets having a rear end and a forward end, a top and a plurality of sides, each of the side having an opening proximate the rear end, wherein each of the brackets is configured to be inserted into a corresponding opening in the interfacing flange; and a plurality of couplers, such as fasteners coupled to locking nuts, for coupling the brackets to the uprights via the openings in the extending surface and in the sides of the brackets.

The extending surface may be substantially perpendicular to the mounting flange and the bracket interfacing flange. In addition, each of the second plurality of openings may be generally rectangular, preferably generally square. Moreover, the forward end of each of the plurality of brackets may be angled upward, e.g., between about 15 degrees and about 45 degrees, preferably between about 25 degrees and about 35 degrees, still more preferably about 30 degrees. The sides and top of the brackets may form a U-shape channel, the tops may also have a plurality of openings for fastening shelves to the brackets, and the front ends of the brackets may be covered by caps.

The system may further comprise a plurality of fasteners for fastening the uprights to a wall, wherein the fasteners may be bolts for engagement with a support behind the wall.

Additionally, the extending surface of the uprights may comprise a recess at one end and a tab at an opposite end, wherein the recess on an extending surface of one upright is adapted to interface with a tab on an extending surface of a second upright in order to align said uprights vertically. The tab and recess may further have at least one hole each that align when the tab and recess interface in order to receive an additional at least one fastener to secure the uprights together.

These and other features and advantages are evident from the following description of the present invention, with reference to the accompanying drawings.

DETAILED DESCRIPTION OF THE INVENTION

Figure 1:
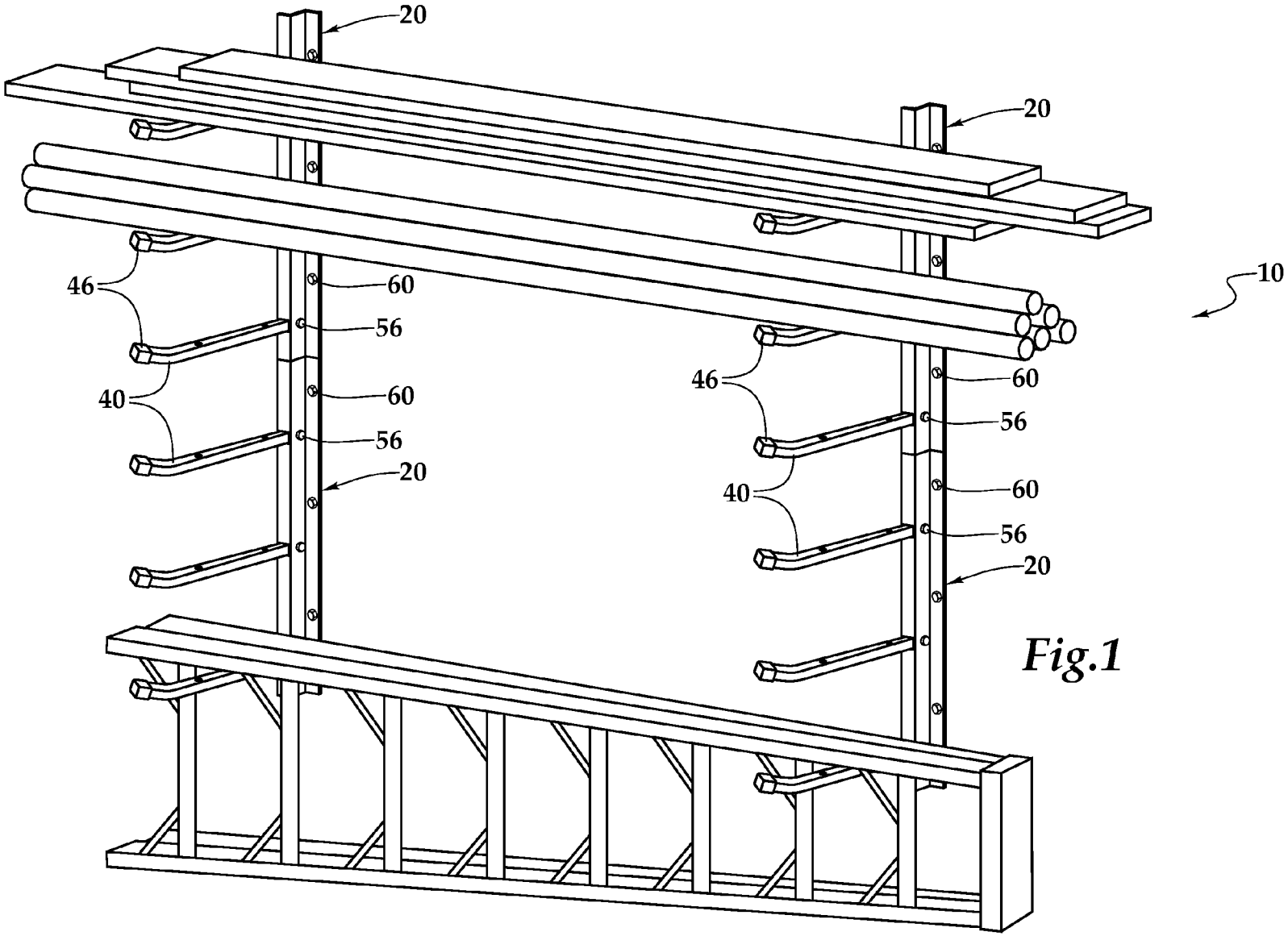
FIG. 1 is one embodiment of the storage system of the present invention vertically aligned with a second, similar system illustrating potential uses for the system.
Figure 2:
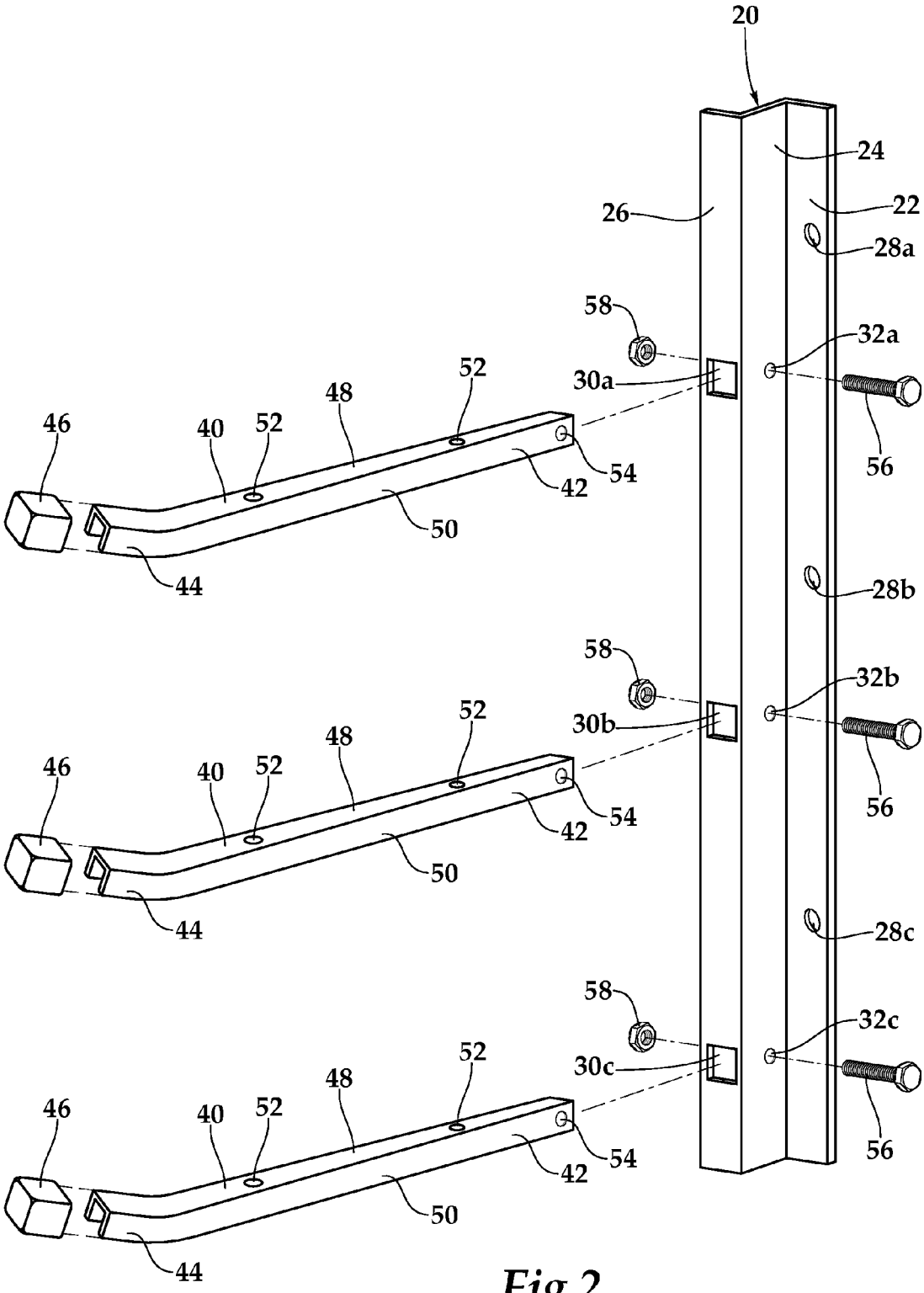
FIG. 2 is an exploded, perspective view of one half of one of the storage systems shown in FIG. 1.

Referring to FIGS. 1-2, a novel wall mountable storage system 10 is shown. System 10 includes a plurality of uprights 20 spaced apart from each other, each of said uprights configured to interface with a plurality of brackets for supporting objects. System 10 is generally lightweight and compact but can support significant loads.

As can be seen in FIGS. 1-2, uprights 20 may be of a unitary construction, formed by bending a rigid yet formable material such as sheet metal into a generally S-shaped configuration. As such, each upright 20 may comprise a generally planar wall-contacting flange 22 connected to a generally planar extending surface 24, which is connected in turn to a generally planar bracket interfacing flange 26. Flanges 22 and 26 may be acutely or obtusely angled with respect to surface 24, but preferably flanges 22 and 26 are generally perpendicular to surface 24 and, therefore, generally parallel to each other. Wall-contacting flange 22 may have a plurality of openings 28 through which fasteners 60 may pass in order to secure uprights 20 to wall. Preferably, each upright 20 may be mounted at a location overlying a support 4 behind wall 2, such as overlying the studs placed at regular intervals behind wall 2. Each upright 20 may have at least two openings 28 to secure and rotationally lock upright 20, and uprights 20 preferably have three or more openings 28.

Each extending surface 24 may also have a plurality of openings 32 spaced along a length of surface 24. Openings 32 in extending surface 24 may be aligned with openings 28 in mounting flange 22. Preferably, however, openings 32 may be offset from openings 28 and, more preferably, openings 32 may be spaced generally equidistantly between openings 28.

Similarly, each bracket interfacing flange 26 may have a plurality of openings 30 for receiving brackets 40. Openings 30 may be generally similar in shape to cross-section of bracket 40. For example, openings 30 may be generally rectangular and, preferably, generally square. In addition, bracket-receiving openings 30 in bracket interfacing flange 26 may be generally aligned with openings 32 in extending surface 24.

Staying with FIGS. 1-2, brackets 40 may be formed of a similar material as uprights 20. In addition, brackets 40 may be formed in a manner similar to uprights 20, e.g., by bending bracket 40 material to a desired shape. Moreover, uprights 20 and/or brackets 40 may coated, e.g., by powder coating, which may increase the durability of system 10. As seen in FIG. 2, brackets 40 may comprise material on three sides, i.e., an upper surface or top 48 and sides 50, and have an open side, so as to comprise a generally U-shaped channel. In other embodiments, brackets 40 may have alternative shapes or be enclosed surfaces such as pipes or tubes. However, brackets 40 as shown in FIG. 2, may be lighter than these alternatives, which may significantly reduce material costs and loading on mounting fasteners 60 while maintaining rigidity and load capabilities of these alternative shapes.

Brackets 40 may have a rear end 42 and a forward end 44, with a cap 46 at forward end and a plurality of openings 54 in sides 50 at rear end 42. When rear end 42 of bracket 40 is inserted into bracket opening 30 and guided rearward, openings 54 in brackets 40 align with openings 32 in extending surface 24 of upright 20 to admit passage of a coupler 56. Coupler 56 may comprise a fastener such as a bolt with a hex-head and/or Phillips-type recess and may be coupled to a locking nut 58 to secure bracket 40 to upright 20. In one embodiment, bolt may be about 1" long with about a ¼" diameter.

Brackets 40 may be generally planar and generally perpendicular to uprights 20 to provide a substantially level surface for holding objects. Upper surface 48 of brackets 40 may support one or more shelves (not shown), and generally planar nature of brackets 40 may assist in leveling of shelves. In addition, in order to secure shelves, upper surface 48 may include one or more holes 52 such that a fastener can be driven through holes 52 and into shelves. However, as seen in FIG. 1, forward end 44 of brackets 40 may be angled upward. Angling of forward end 44 may aid in keeping objects in place when resting on brackets 40, e.g., when pipes or other objects prone to rolling are placed on brackets 40. Angle may be between about 15 degrees and about 45 degrees, preferably between about 25 degrees and about 35 degrees, and in one embodiment, about 30 degrees.

Figure 3:
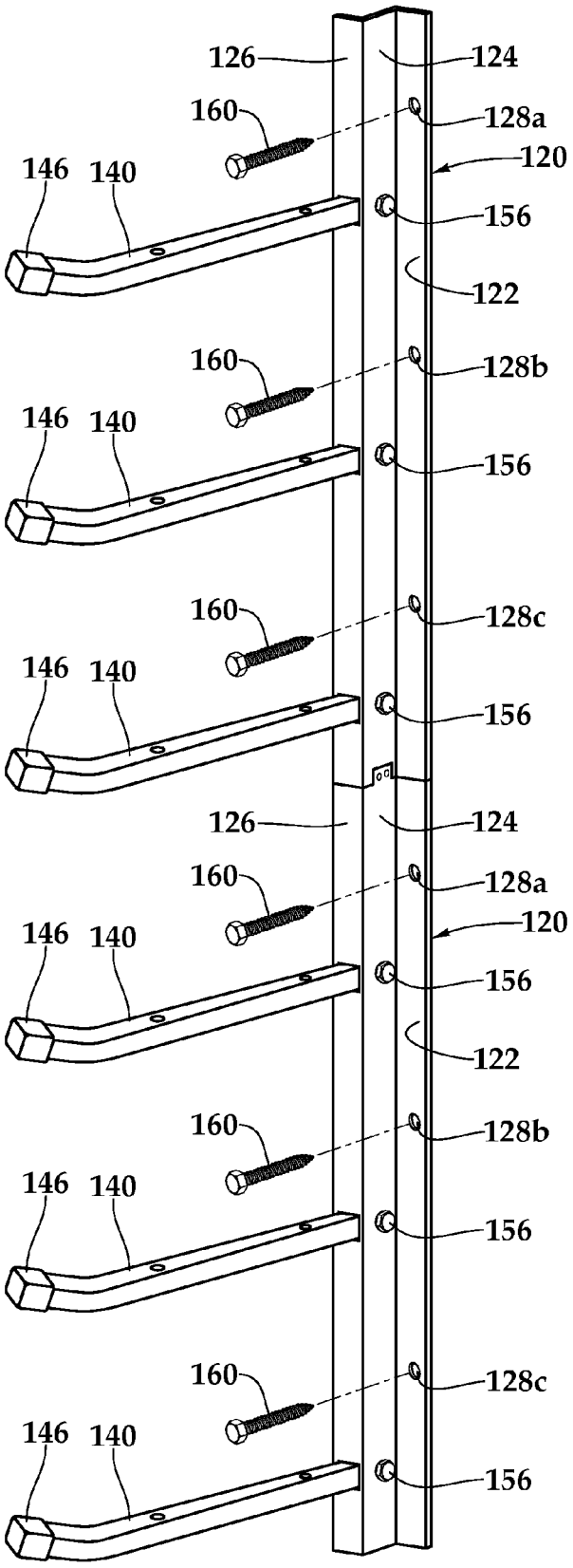
FIG. 3 is a perspective view of one half of a second embodiment of a storage system of the present invention.
Figure 4:
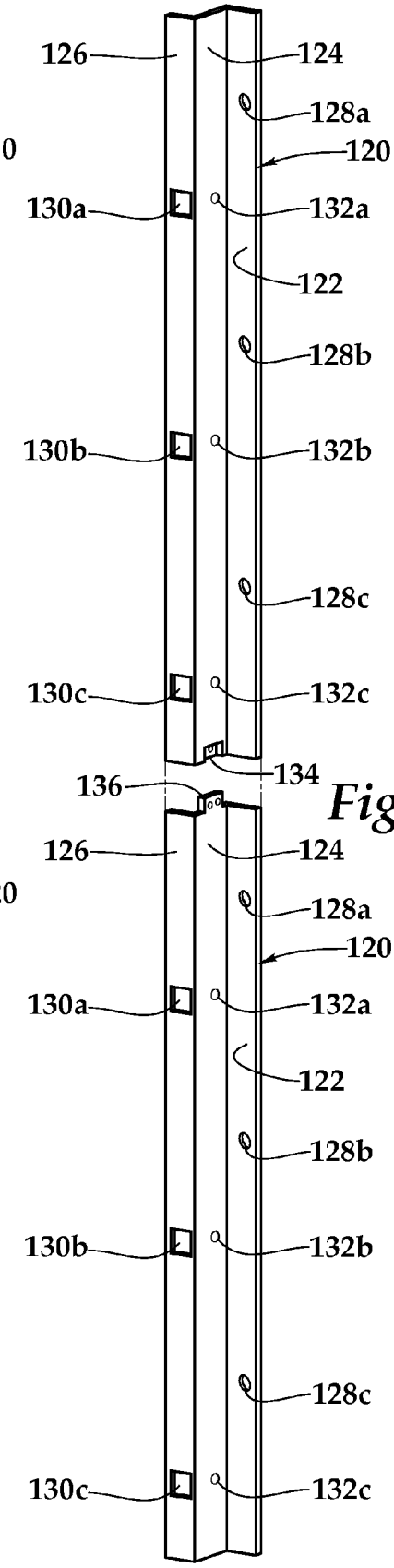
FIG. 4 is an exploded, perspective view of the half of the second embodiment shown in FIG. 3.

Turning to FIGS. 3-4, in another embodiment, system 110 may allow for interfacing between one or more uprights 120 in order to vertically align uprights 120. For example, extending surfaces 124 of uprights 120 may have a coupling recess 134 at one end and a coupling tab 136 at an opposite end. In the embodiment shown in FIGS. 3-4, tab 136 is located on top of extending surface 124 while recess 134 is located on the bottom. However, recess 134 may be located on top with tab 136 on the bottom. In addition, or alternatively, uprights 120 may comprise corresponding tabs and recesses on mounting flange 122 and/or bracket interfacing flange 126.

Returning to FIGS. 1-2, uprights 20 may each be between about 20" and about 30" long, preferably between about 24" and about 30" and, in one embodiment about 26¾" long; between about 1" and about 4" wide, preferably about 2" wide; and between about 1" and about 6" deep, preferably between about 2" and about 4" and in one embodiment about 3¼". Brackets 40 may be between about 6" and about 20" long, preferably between about 10" and about 16"; and between about ½" and about 1½" both high and wide, preferably about ¾".

Openings 28 for accepting fasteners 60 to couple uprights 20 to wall 2 may be spaced equidistantly. For example, in the case of three openings 28*a*, 28*b* and 28*c*, an uppermost opening 28*a* may be between about 3" and 4" from upper edge of upright 20, the next opening 28*b* may be between about 7" and about 8" from opening 28*a* and the lowest opening 28*c* similarly may be between about 7" and about 8" from opening 28*b*.

Similarly, openings 30 for receiving brackets 40 and openings 32 for couplers 56 may be equally spaced apart from each other, for example spaced generally midway between consecutive fastener openings 28. Upper openings 30*a* and 32*a* may be spaced between about 5" and about 8" from a top of upright 20, preferably between about 6" and about 7". In this way, system 10 includes at least one fastener 60 mounted into substrate 2 above an uppermost bracket 40, which means that at least a portion of loading on system 10 contain a vertical shear component, which may assist in increasing the strength of system 10 since shear loading may resist pullout more than loading with a large bending moment component. Fastener 60 may be a bolt, such as a carriage bolt, and, in one embodiment, may be about 2" long with about a 5/16 diameter in order to embed in support 4 underlying wall 2 and to provide sufficient coupling of system 10 to wall 2.

Figure 5:
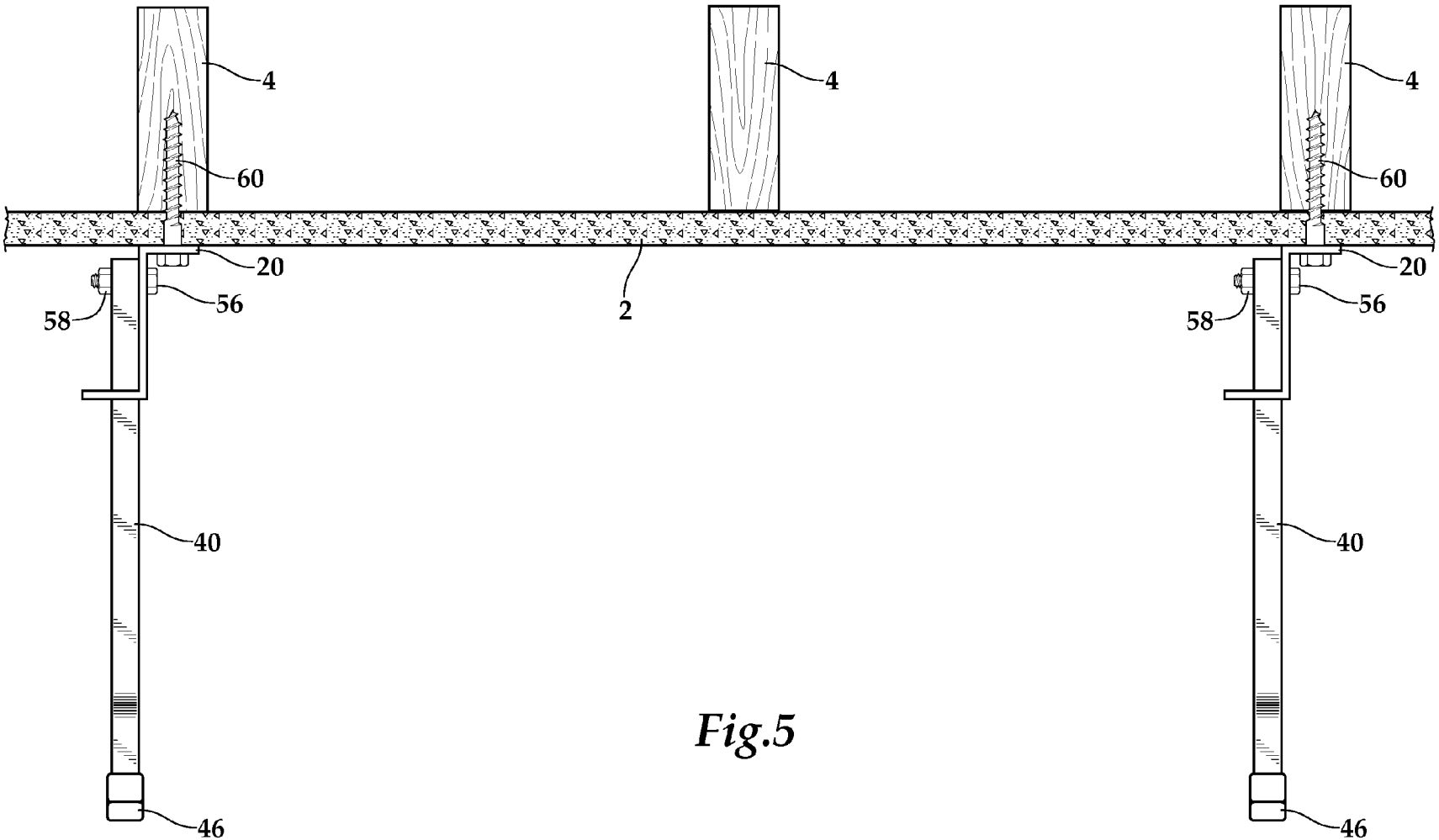
FIG. 5 is a top view of the storage system of FIG. 1 with the mounting substrate and supports sectioned to illustrate mounting of the system.

To employ system 10, at least two uprights 20 may be mounted to wall 2, preferably at locations overlying supports 4, by inserting fasteners 60 through openings 28 in mounting flanges and embedding fasteners 60 in wall, as can be seen in FIG. 5. Brackets 40 may be inserted into openings 30 until holes 54 in rear ends 42 of brackets 40 align with holes 32 in extending surface 24. To secure brackets 40, fasteners 56 may be inserted through holes 32 and 54, and fasteners 56 may be secured with locking nuts 58. Caps 46 additionally may be placed on forward ends 44 of brackets 40 and shelves may be placed on, or mounted to, upper surfaces 48 of brackets 40.

When assembled, system 10 may provide a relatively compact, high strength method for supporting objects. In comparison to freestanding storage racks, system 10 may be significantly less deep, which may allow system 10 to be used in additional applications where space may be a concern. In addition, since system 10 may be mounted to a wall 2, it may not require open floor space beneath system 10 as in the case of free-standing units, which may further increase its modularity, e.g., by allowing it to be mounted over doorways or other obstructions.

System may have a total weight of about 8½ lbs but, when mounted to supports 4 underlying wall 2, may have a holding capacity of about 450 lbs. Brackets 40 contact uprights 20 in more than one location, which may account for some of the strength of system 10. For example, fastening of bracket 40 to upright 20 at rear end 42 may prevent lateral movement or misalignment of bracket 40 while providing a path for the force of applied loads to be transmitted to uprights 20 and, ultimately, into supports 4. Fastening of bracket 40 to upright 20 may also prevent accidental dislodgement of bracket such as when a load is removed and an upward force is accidentally applied to bracket 40.

In addition, application of a load to bracket 40 causes bracket to contact upright 20 at opening 30 in interfacing flange 26. Since opening 30 is spaced from rear end 42 of bracket, the moment arm for a torsional force on system 10 may be reduced. Since bending moments are calculated as the vertical component of the applied load times the length of the moment arm, this reduces the bending moment experienced by system 10, thereby increasing the shear component of loading. Moreover, since fasteners 60 may have a higher holding capacity with respect to shear loads as compared to bending moments, system 10 may be able to withstand increased loading.

Other variations of system 10 are within the scope of the invention, including, e.g., having more of fewer brackets 40 or mounting openings 28 and fasteners 60 and/or longer or shorter uprights 20.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A wall-mountable storage system, comprising:

a plurality of S-shaped uprights having a mounting flange, an extending surface and a bracket interfacing flange, each upright having a plurality of first openings spaced along said mounting flange, a plurality of second openings spaced along said bracket interfacing flange and a plurality of third openings spaced along said extending surface;

a plurality of brackets having a rear end and a forward end, a top and a plurality of sides, each of said sides having an opening proximate said rear end, wherein each of said brackets is configured to be inserted into a corresponding opening of said plurality of second openings; and a plurality of couplers for coupling said brackets to said uprights via said plurality of third openings and said openings in said sides of said brackets;

wherein said top and said plurality of sides form said rear end and said rear end is planar;

and wherein one of said plurality of second openings is configured to receive said top of one of said plurality of brackets.

2. A wall-mountable storage system according to claim 1, wherein said extending surface is substantially perpendicular to said mounting flange and said bracket interfacing flange.

3. A wall mountable storage system according to claim 1, wherein each of said plurality of second openings is generally rectangular.

4. A wall mountable storage system according to claim 1, wherein forward end of each of said plurality of brackets is angled upward.

5. A wall mountable storage system according to claim 4, wherein, for each bracket, said angle is about 30 degrees relative to a plane containing an upper surface of said bracket.

6. A wall mountable storage system according to claim 1, wherein each of said couplers comprises a fastener and a locking nut.

7. A wall mountable storage system according to claim 1, further comprising a plurality of fasteners for fastening said uprights to a wall.

8. A wall mountable storage system according to claim 1, further comprising a plurality of caps for covering said front ends of said brackets.

9. A wall mountable storage system according to claim 1, wherein said sides and said top of said brackets form a U-shaped channel.

10. A wall mountable storage system according to claim 1, wherein said top of said brackets have a plurality of openings for fastening shelves to said brackets.

11. A wall mountable storage system according to claim 1, wherein an uppermost first opening is disposed higher on each of said uprights than an uppermost second opening.

12. A wall mountable storage system according to claim 1, further comprising:

a recessed portion on one of said uprights; and an extending tab on a second one of said uprights;

wherein said recessed portion is configured to receive said extending tab.

13. A wall mountable storage system according to claim 12, wherein said recessed portion is disposed on an extending surface of said one of said uprights, and said extending tab extends away from an extending surface of said second one of said uprights.

* * * * *